United States Patent [19]

Haar

[11] Patent Number: 4,783,072

[45] Date of Patent: Nov. 8, 1988

[54] SPORTING EQUIPMENT

[76] Inventor: Lawrence Haar, 8519 E. Belgian Trail, Scottsdale, Ariz. 85258

[21] Appl. No.: 87,381

[22] Filed: Aug. 20, 1987

[30] Foreign Application Priority Data

Aug. 27, 1986 [RH] Zimbabwe ..... 173/86

[51] Int. Cl.[4] ..... A63B 51/12

[52] U.S. Cl. ..... 273/73 E; 273/73 R

[58] Field of Search ..... 273/73 E, 73 R

[56] References Cited

U.S. PATENT DOCUMENTS 2,311,172 2/1943 Hetzel ..... 273/73 E 3,904,202 9/1975 DeLorean ..... 273/73 H

FOREIGN PATENT DOCUMENTS 5358 of 1889 United Kingdom ..... 273/73 E

*Primary Examiner*—Leo P. Picard

[57] ABSTRACT

A tennis racket has a head having head strings passing through string holes and lieing substantially in a single plane. There is a groove running along a portion of the outside periphery of the head. A flexible member is slidably received in the groove. This member has string apertures therethrough which can register or substantially register with the string holes in the head and the head strings are strung through the said string apertures as well as the string holes. In the throat of the racket there is a tensioning device comprising at least one pinion having a toothed periphery which threadedly engages with teeth on the end portion of the flexible member. By rotating the pinion the flexible member will be moved so as to vary the tension of the strings. A pawl prevents unwanted return movement of the pinion.

6 Claims, 3 Drawing Sheets

58
60
62
64
66
68
72
74
76
78
80
82
84
86
90
92
94
96

SPORTING EQUIPMENT

This invention relates to sporting equipment.

BACKGROUND OF THE INVENTION

This invention is concerned with a device for use with a stringed sporting implement, and in particular a tennis racket, having a head carrying one or more strings lieing substantially in a single plane. The characteristics of the implement may vary considerably by the amount of tension in the strings. Certain players find it desirable to alter the tension in the strings. Normally this would have to be effected in a sports shop or other location where there is a stringing machine available. Thus it is normally not possible to vary this tension in a sporting implement when in use. Some players find this unsatisfactory as during use the tension in the strings may become relieved and it would become desireable to increase the tension in the strings. Alternatively the player may find that the tension is too great for the playing conditions during the match.

A suggestion has been made in U.S. Pat. No. 4,340,225 to have incorporated in the head a number of studs which are screw threaded into the body of the head and over which the strings pass. The inside ends of the studs are provided with hexagonal recesses which are engageable by an Allen key to rotate the studs and hence move them axially relative to the head so that the tension in the strings can be adjusted. Although this will provide for the adjustment of such tension, it will be difficult to achieve even adjustment of the strings. In addition it will be difficult to achieve a desired amount of tension as the amount of tension will be effected on a rather hit and miss way. Furthermore the adjustment will take considerable time so that it will not be practical to attempt to adjust the string tension during the intervals in a match.

It is an object of the invention to provide a device for a stringed sporting implement such as a tennis racket which permits the tension in the strings to be easily adjusted and in particular to be adjusted during short intervals of rest in use of the implement in a game.

It is another object of the invention to provide a device for a stringed sporting implement such as a tennis racket which permits the tension in all the strings to be adjusted at one time.

SUMMARY OF THE INVENTION

Accordingly of the present invention provides a device for incorporation in a stringed sporting implement such as a tennis or similar racket having a head carrying strings lieing substantially in a single plane, the device comprising at least one pulley the periphery of which is operatively connected to the string or strings and means for rotating the pulley so as to vary the tension of the string or strings. Preferably two pulleys are provided and either (a) the ends of a single string may be connected respectively to the pulleys or (b) one string may be connected to one pulley and another string which in the racket head runs at right angles to to the first mentioned string may be connected to the other pulley.

A suitable ratchet device may be provided to prevent the pulley(s) from releasing the tension in the string(s) inadvertently. A gear wheel is preferably connected to the or each pulley and this gear wheel is preferably driven by a manually operable pinion, there conveniently being a small lever for rotating the pinion.

Where there are two gear wheels, these preferably mesh so that they exert the same tension on the string(s).

The invention also provides in one embodiment a member which lies against the head of the implement, preferably the outside of the head, and has openings through which the strings pass, the member being movable relative to the head so as to increase the tension on the strings. In an alternative a master string is provided which is connected to head strings with which the head is strung. By pulling on the master string the various head strings will be tensioned.

SHORT DESCRIPTION OF THE DRAWINGS

Figures 4, 5, 6, 7:
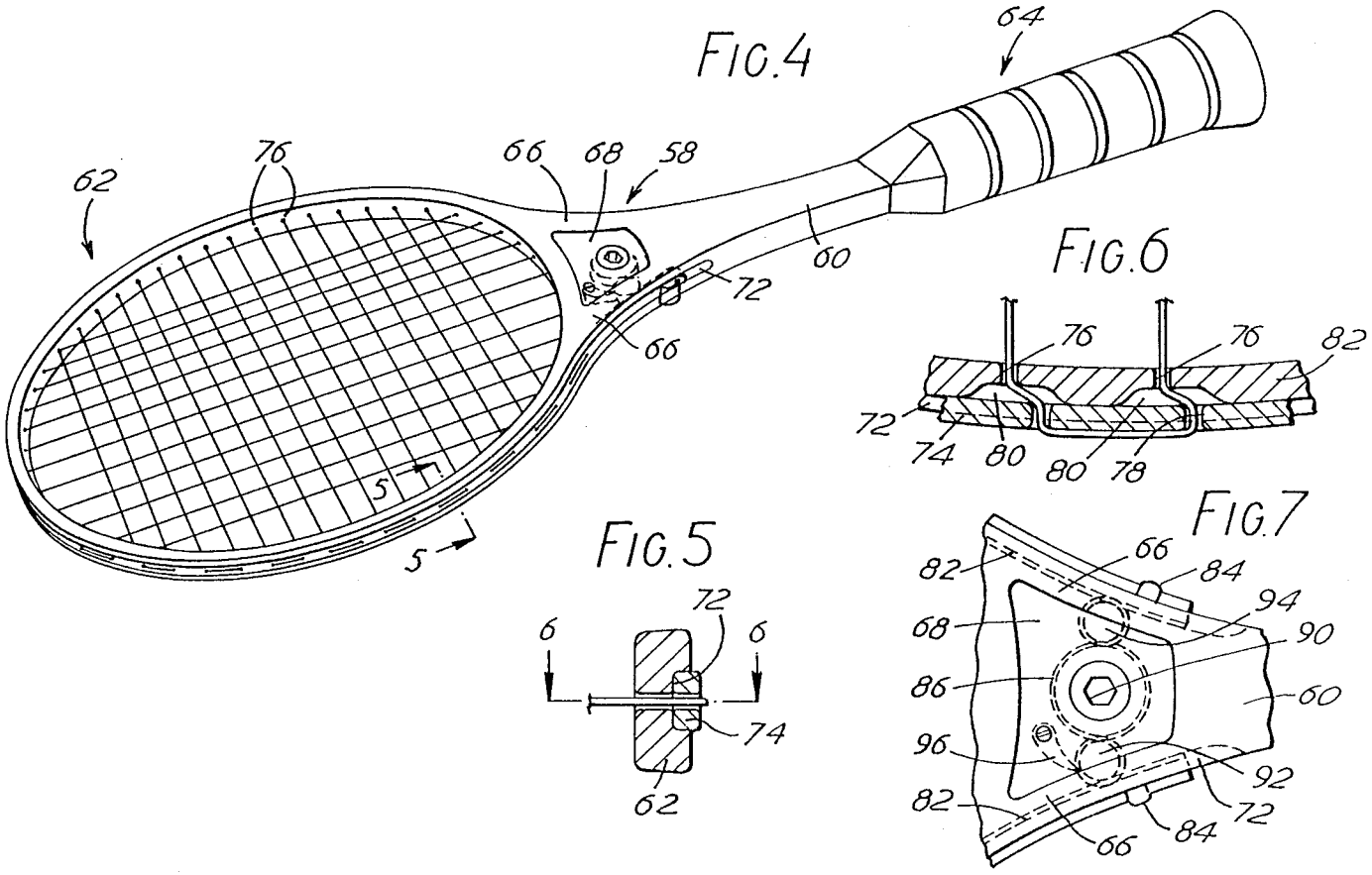
Figure 8:
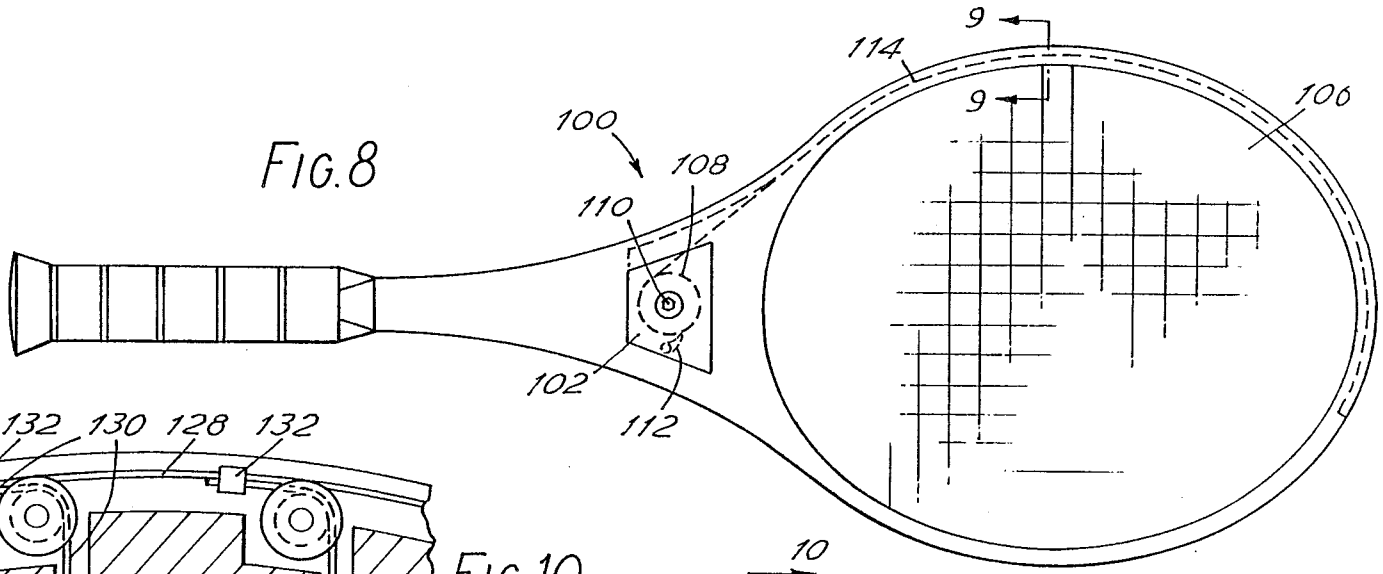
Figure 9:
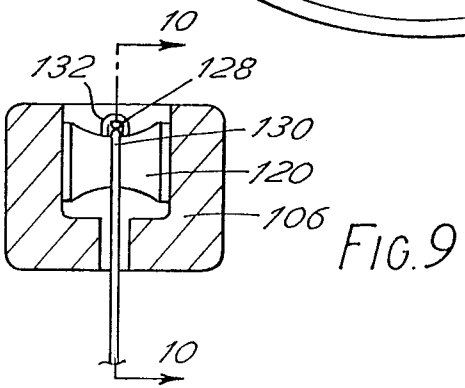
Figure 10:
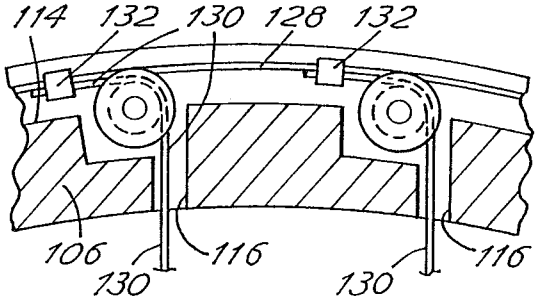
Figure 11:
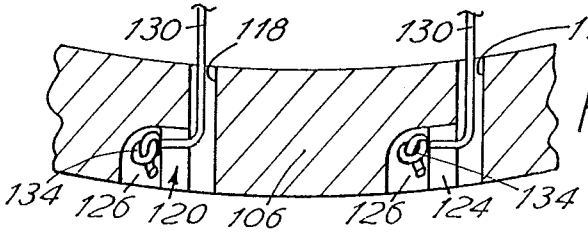

FIG. 4 is a a perspective view of tennis racket including another tensioning device of the invention, FIG. 5 is a section on line 5—5 of FIG. 4, FIG. 6 is a section on line 6—6 of FIG. 5, FIG. 7 is a detail plan of the tennis racket, FIG. 8 is a plan of a tennis racket incorporating a further tensioning device of the invention, and FIG. 9 is a section on line 9—9 of FIG. 8, FIG. 10 is a section on line 10—10 of FIG. 9 of one side of the head of the tennis racket, and FIG. 11 is a section similar to FIG. 10 through the other side of the head.

DESCRIPTION OF A FIRST EMBODIMENT OF THE INVENTION

Figure 1:
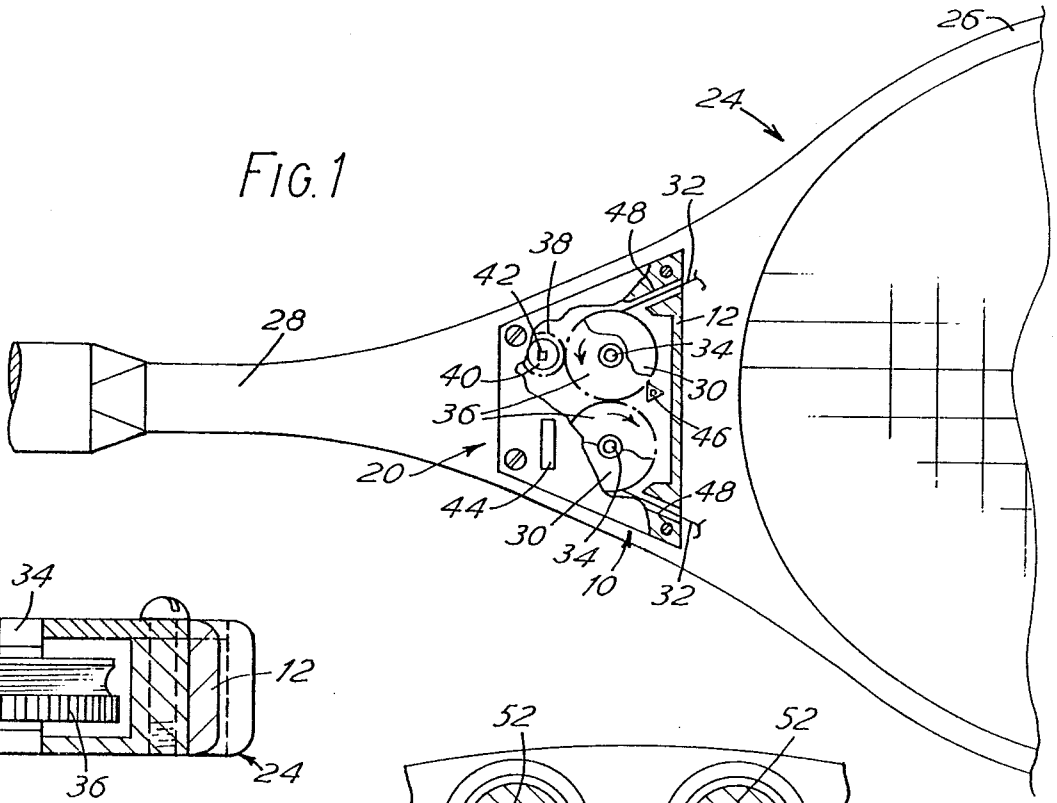
FIG. 1 is a plan, partially in section, of a tensioning device of the invention for use with a tennis racket.
Figure 2:
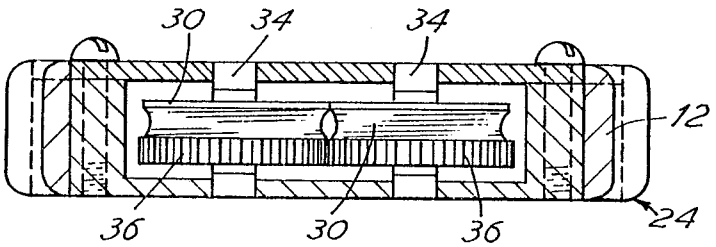
FIG. 2 is a diagrammatic section on line 2—2 of FIG. 1
Figure 3:
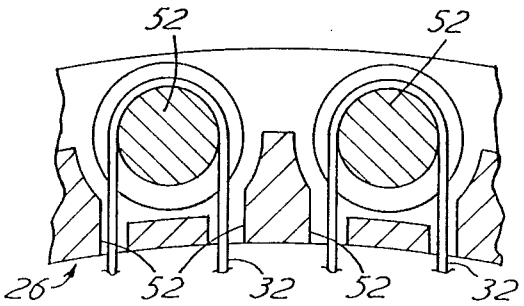
FIG. 3 is an enlarged detail of a part of the head.

Referring now to FIGS. 1 to 3, there is shown a string tensioning device 20 of the invention. The device 20 comprises a housing 22 which is conveniently shaped so as to be received within the throat of a tennis racket 24 (only partially shown) that may be metal framed or of any other conventional suitable construction and that has an ovaloid head 26 and shank 28.

The housing 22 contains a pair of substantially identical pulleys 30 each having a notch or the like (not shown) whereby the end of a string 32 can be secured to the pulley. Each pulley 30 is mounted on a shaft 34 which carries a gearwheel 36. The two gearwheels 36 are of the same diameter and mesh with one another. A pinion 38 carried on a stub shaft 40 meshes with one of the gearwheels 36. The stub shaft 40 has a square recess 42 in which a suitable key may engage to rotate the stub shaft 40 and hence the gearwheels 36 and the pulleys 30.

A counter device, indicated generally at 44, is provided to give an indication of the angle of rotation of the gearwheels 36 and hence the tension applied to the strings.

A ratchet device indicated at 46 is provided to engage one of the gearwheels 36 to prevent the pulleys rotating freely in such a way as to relieve the said tension in the strings 32 as will be described.

Suitable guides 48 are provided to ensure that the strings 32 exit from the housing 22 at the correct angle.

The head 26 of the racket 24 is provided with small rollers 50 (see FIG. 3) arranged with their axes normal tot he plane containing the strings 32.

In use, the tennis racket 24 will be strung with a single string 32 which will have one end connected to one of the pulleys 30 and the other connected to the other pulley 30. It will have been strung through openings 52 in the head and over the rollers 50 in conventional manner i.e. with spaced runs at right angles to one another. By rotating the stub shaft 40 by means of the key, the pinion 38 will be rotated and hence the gearwheels 36 and the pulleys 30 will rotate. Thus the tension in the strings will be adjusted as desired by the player.

DESCRIPTION OF ANOTHER EMBODIMENT OF THE INVENTION

Reference is now made to FIGS. 4 to 7. Here is shown a tennis racket 58 comprising a shank 60 carrying an ovaloid head 62 at one end and a hand grip 64 at the other end. At the head 62, the shank 60 divides into a pair of outwardly diverging yoke arms 66 in the space between which is the control mechanism 68 for an adjusting device.

A shallow groove 72 runs along the periphery of the head 62 and extends into the shank 60 beyond the yoke arms 66. A robust flexible member 74 is slidably received in this groove 72. The head 62 has string holes 76 therethrough in the usual pattern and corresponding holes 78 are provided in the member 74. When the member 74 is in its neutral position, the holes 76 and 78 register. The head 62 is provided with countersunk openings 80 for the holes 76 below the member 74 (best seen in FIG. 7).

The inside surfaces of the ends of the member 74 are provided with teeth (indicated diagrammatically at 82). Inverted "U"-shaped guides 84 overlie the ends of the member 74 to hold them in the groove 72.

The adjusting device 70 includes a centrally located main gearwheel 86 which is mounted on a shaft 88 having an hexagonal socket 90 so as to be rotatable by an Allen key. The gearwheel 86 meshes with a pair of pinions 92 and 94 that in turn mesh with the teeth 82 on the member 74.

A pawl 96 is contained within the device 70 to engage the pinion 92 to prevent this rotating backwards. This pawl 96 is mounted on a rotatable shaft which has a cross-cut so that the pawl can be moved with a screwdriver or the like out of engagement with the teeth of the pinion 92 to permit reverse movement of the pinion 92.

In use, with the flexible member 74 in its neutral position, the head 62 is strung in the usual way save that the strings 80 pass through both the holes 76 and 78. The strings are provided with the desired tension.

When the tennis racket is being used in a game, should the player wish to increase or decrease the tension of the strings, the player uses an Allen key to rotate the gearwheel 86 and hence move the flexible member 74 so that the holes 76 and 86 are offset from one another (as shown in FIG. 7) so that the tension in the strings 80 is increased. Should the player wish to relieve the tension, then, having first moved the pawl 96 into a neutral position, the gearwheel 86 is rotated in the opposite direction so that the holes 76 and 78 are more in register.

It will be noted that the strings hold the flexible member 74 firmly in the groove 72.

If desired, the pinions may be of greater diameter than the gear wheel to facilitate fine adjustment of tension in the strings. Further only a single pinion 92 may be provided for moving the flexible member 74 in both directions. The guides 84 too may be omitted.

A counter may be provided for the gearwheel 86 as described above so that the player can geat an indication of the amount of tension applied. This indication can also or alternatively be obtained by locating the position of the ends of the flexible member 74 relative to a datum point. This datum point may be indicated by a guide 84 or a suitable mark on the head.

DESCRIPTION OF A THIRD EMBODIMENT

The tennis racket 100 of FIGS. 8 to 11 has a control mechanism 102 at its throat 104 close to its ovaloid head 106. The control mechanism 102 includes a pulley 108 mounted on a shaft having an hexagonal socket 110 to be rotated by an Allen key (not shown). A ratchet and pawl device (only the pawl 112 being shown) prevents the pulley 108 being moved backwardly inadvertently. A groove 114 is provided running along the outside periphery of the head 106.

The head 106 is provided with thread holes 116 on one half of the head and opening into the groove 114 and thread holes 118 on the other side of the head 106. thread holes 116 and 118 being arranged in the usual pattern. Low friction devices in the form of rollers 120 are provided outside the thread holes 116. On the other side of the head there are holding means 122 adjacent the thread holes 118. The holding means 122 comprise crossmembers each having a slot 124 leading to a recess 126.

A master string 128 has one end rotatably connected to the pulley 108 and extends along the groove 114. Head strings 130 are connected to the master string 98 by means of plastic ferrules 132 crimped thereon. These head strings 130 are pre-set in a factory with knots 134 or other stop means formed thereon at the appropriate locations as will become clear below.

The thread holes 116 and 118 are of sufficient diameter for the knots 134 or other stop means to pass therethrough but the slots 124 are only slightly wider than the diameter of the head strings so that the head strings 130 but not the knots 134 can pass through the slots.

The racket is strung as follows: The master string 128 is connected to the pulley 108 and is fully played out. The head strings 130 are passed through the appropriate thread holes 116 and 118 and woven as may be appropriate. When each head string 130 is passed through its appropriate thread hole 118, it is threaded through the slot 120 and the knot 134 is laid in the recess 126. The master string 128 which has been quite loose is now tensioned by rotating the pulley 108. As all the head strings 130 are of the correct length, they will all be correctly and equally tensioned as the master string 128 is tensioned.

It will be seen that with this arrangement a lay person can string the racket without needing the assistance of a professional. Furthermore the tension in the head strings can be adjusted as desired during a match.

GENERAL

The tensioning devices can be made from very light material so as not to affect the balance of the tennis racket adversely. They provide means whereby a player can adjust the string tension quickly and easily during a match to compensate for string stretch or for any other factor which affects his play.

In addition, the tensioning device may be used to permit a player to restring his own racket without having to seek professional assistance.

It will be appreciated that other anti-friction devices should be provided in the frame head to permit the tension in the strings to be consistent over their entire length.

The invention is not limited to the precise constructional details hereinbefore described and illustrated. For example, the racket of the first embodiment may be strung with two strings each having one end connected to the racket head and the other to one of the two pulleys. An electro-mechanical counter may be used conveniently with an LED read-out and possibly with a memory to assist in adjusting the string tension repeatably.

The scope of the invention is limited soley by the scope of the following claims.

What I claim is:

1. A stringed sporting implement having
(a) a head having
(i) string holes therethrough,
(ii) a groove running along at least a portion of its outside periphery and communicating with at least some of the string holes, and
(iii) holding means located at least opposite the said groove;
(b) string means with which the said head is strung, the string means comprising
(i) a master string the major portion of which lies in the said groove,
(ii) a plurality of head strings that pass through the said string holes in the head, the said head strings
(A) at one end thereof having stop means which co-operate with the said holding means to retain the head strings said ends of to the head, and
(B) being connected at their other ends to the said master string; and
(c) a tensioning device comprising
(i) at least one member connected to the master string, and
(ii) means for moving the said member so as to vary the tension of the strings, and
(iv) retaining means to prevent unwanted movement of the said member.

2. A stringed implement as claimed in claim 1 in which the head is provided with rollers adjacent to the said groove over which the said head strings pass.

3. A stringed implement as claimed in claim 1 in which retaining means comprises a ratchet wheel and a pawl engageing therewith.

4. A stringed implement as claimed in claim 1 in which the said one member comprises a pulley to which one end of the said master string is connected.

5. A stringed sporting implement having
(a) a handle having a throat at one end,
(b) a head carried by the throat and having
(i) string holes therethrough,
(ii) head strings passing through the string holes and lieing substantially in a single plane, and
(iii) a groove running along at least a portion of its outside periphery and terminating at at least one end at the throat; and
(c) a tensioning device comprising
(i) at least one rotary member having a toothed periphery;
(ii) a flexible member received within the said groove to slide therealong, the said member having
(A) string apertures therethrough over the major portion thereof, the said string apertures in one position of the said flexible member relative to the head registering or substantially registering with the said string holes, the said head strings being strung through the said string apertures as well as the string holes,
(B) an end portion beyond the said string apertures, and
(C) internal teeth at at least the said end portion, which said teeth mesh with the said toothed periphery of the said rotary member,
(iii) means for rotating the rotary member so as to vary the tension of the strings, and
(iv) retaining means to prevent unwanted movement of the said rotary member.

6. A stringed implement as claimed in claim 5 further comprising means to hold the end portion of the flexible member in position in the groove.

* * * * *